US010429783B2

(12) United States Patent
Imaizumi et al.

(10) Patent No.: US 10,429,783 B2
(45) Date of Patent: Oct. 1, 2019

(54) FIXING APPARATUS AND HEATER USED IN THE SAME THAT SUPPRESSES THERMAL STRESS FROM BEING CREATED IN THE HEATER

(71) Applicant: CANON KABUSHIKI KAISHA, Tokyo (JP)

(72) Inventors: Toru Imaizumi, Kawasaki (JP); Hikaru Osada, Kamakura (JP); Nozomu Nakajima, Kawasaki (JP); Shoichiro Ikegami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/937,712

(22) Filed: Mar. 27, 2018

(65) Prior Publication Data

US 2018/0284664 A1 Oct. 4, 2018

(30) Foreign Application Priority Data

Mar. 30, 2017 (JP) ..... 2017-069288

(51) Int. Cl.
*G03G 15/20* (2006.01)
*G03G 15/00* (2006.01)

(52) U.S. Cl.
CPC ..... *G03G 15/2053* (2013.01); *G03G 15/2042* (2013.01); *G03G 15/2064* (2013.01); *G03G 15/80* (2013.01); *G03G 2215/2048* (2013.01)

(58) Field of Classification Search
CPC ..... G03G 15/2053
USPC ..... 399/330
See application file for complete search history.

(56) References Cited

U.S. PATENT DOCUMENTS

| | | | | |
|---|---|---|---|---|
| 9,098,035 | B2 * | 8/2015 | Nakahara | G03G 15/2053 |
| 2014/0169845 | A1 * | 6/2014 | Nakahara | G03G 15/2053 399/328 |
| 2015/0227091 | A1 * | 8/2015 | Ando | G03G 15/2046 399/33 |

FOREIGN PATENT DOCUMENTS

| | | | |
|---|---|---|---|
| JP | 8-272249 | A | 10/1996 |
| JP | 9-297478 | A | 11/1997 |
| JP | 2004-170950 | A | 6/2004 |
| JP | 2005-228543 | A | 8/2005 |
| JP | 2010-026448 | A | 2/2010 |

* cited by examiner

*Primary Examiner* — Quana Grainger
(74) *Attorney, Agent, or Firm* — Canon U.S.A., Inc. IP Division

(57) ABSTRACT

In a fixing apparatus, a width of a first portion of a first heat generating resistor is narrower than a width of a second portion, at least a portion of an outline of the first portion on the near side with respect to a power shut-off member is provided at a position closer to the power shut-off member than an outline of the second portion on the near side with respect to the power shut-off member, and at least a portion of an outline of the first portion on the far side with respect to the power shut-off member is provided at a position closer to the power shut-off member than an outline of the second portion on the far side with respect to the power shut-off member.

15 Claims, 9 Drawing Sheets

FIXING APPARATUS AND HEATER USED IN THE SAME THAT SUPPRESSES THERMAL STRESS FROM BEING CREATED IN THE HEATER

BACKGROUND OF THE INVENTION

Field of the Invention

The present disclosure relates to a fixing apparatus mounted in an electrophotographic image forming apparatus, such as an LED printer, and to a heater that is used in the fixing apparatus.

Description of the Related Art

In fixing apparatuses installed in an image forming apparatus, a fixing apparatus is known that uses a film and that consumes little power and has short warming up time. Such a fixing apparatus includes a heater including a substrate formed of ceramics such as alumina or aluminum nitride, and a heat generating resistor formed on the substrate. The fixing apparatus fixes a toner image to a recording material with heat of the heater through the film.

Incidentally, in preparation for a malfunction of the heater, in the fixing apparatus, a power shut-off member that is actuated by an abnormal temperature rise of the heater and that stops the supply of electric power to the heater is provided in contact with the heater. A thermal fuse or a thermal switch is used as the power shut-off member.

However, the temperature of the heater in the area of the heater where the power shut-off member is in contact tends to become lower than the areas where the power shut-off member is not in contact. As a result, a difference in fixability of the toner image occurs between the area of the heater where the power shut-off member is in contact and the area of the heater where the power shut-off member is not in contact occurs; accordingly, there are cases in which fixing irregularities occur, or a fixing failure occurs in the area where the power shut-off member is in contact.

Accordingly, Japanese Patent Laid-Open No. 2004-170950 discloses a configuration in which a width of a heat generating resistor in the vicinity of the power shut-off member is formed narrower than a width of the heat generating resistor in an area of the heater that is away from the power shut-off member to locally increase the heat generation amount of the heat generating resistor.

Image forming apparatus of recent years are highly required to be able to perform a quick start. Accordingly, a fixing apparatus that is capable of supplying high power to the heater is in need. Furthermore, in preparation for a case in which an uncontrolled state of the heater occurs, a fixing apparatus that can further suppress thermal stress created by the heater is in need.

SUMMARY OF THE INVENTION

The present disclosure provides a fixing apparatus and a heater that can suppress thermal stress from being created in the heater even when the heater has fallen into an uncontrolled state.

An aspect of the present disclosure is a fixing apparatus including a fixing member, a heater that generates heat by electric power supplied thereto, the heater including a substrate, and a first and second heat generating resistors provided on the substrate along a longitudinal direction of the substrate, and a power shut-off member that is operated by heat of the heater to shut off supply of the electric power to the heater, the power shut-off member being in contact with the heater at a position between the first heat generating resistor and the second heat generating resistor in a lateral direction of the heater. In the fixing apparatus, an image formed on a recording material is fixed to the recording material with the heat of the heater with the fixing member interposed therebetween; in a width of a first portion in the lateral direction, the first portion being a portion of the first heat generating resistor that overlaps a contact area between the power shut-off member and the heater in the longitudinal direction, is narrower than a width of a second portion that is a portion of the first heat generating resistor different from the first portion in the longitudinal direction; in the lateral direction, at least a portion of an outline of the first portion on a near side with respect to the power shut-off member is provided at a position closer to the power shut-off member than an outline of the second portion on a near side with respect to the power shut-off member; and in the lateral direction, at least a portion of an outline of the first portion on a far side with respect to the power shut-off member is provided at a position closer to the power shut-off member than an outline of the second portion on a far side with respect to the power shut-off member.

Another aspect of the present disclosure is a heater used in a fixing apparatus that fixes an image formed on a recording material to the recording material, the heater including a substrate, a first heat generating resistor provided on the substrate along a longitudinal direction of the substrate, and a second heat generating resistor provided on the substrate along the longitudinal direction of the substrate. In the heater, the first heat generating resistor includes a first portion, and a second portion that is a portion of the first heat generating resistor different from the first portion in the longitudinal direction; in a lateral direction of the substrate, the first portion is provided at a position closer to the second heat generating resistor than the second portion; a width of the first portion in the lateral direction is narrower than a width of the second portion; in the lateral direction, at least a portion of an outline of the first portion on a near side with respect to the second heat generating resistor is provided at a position closer to the second heat generating resistor than an outline of the second portion on a near side with respect to the second heat generating resistor; and in the lateral direction, at least a portion of an outline of the first portion on a far side with respect to the second heat generating resistor is provided at a position closer to the second heat generating resistor than an outline of the second portion on a far side with respect to the second heat generating resistor.

Another aspect of the disclosure is a fixing apparatus including fixing member, and a heater that generates heat by electric power supplied thereto, the heater including a substrate, and a first and second heat generating resistors provided on the substrate along a longitudinal direction of the substrate. In the fixing apparatus, an image formed on a recording material is fixed to the recording material with the heat of the heater with the fixing member interposed therebetween; the first heat generating resistor includes a first portion, and a second portion that is a portion of the first heat generating resistor different from the first portion in the longitudinal direction; in a lateral direction of the substrate, the first portion is provided at a position closer to the second heat generating resistor than the second portion; a width of the first portion in the lateral direction is narrower than a width of the second portion; in the lateral direction, at least a portion of an outline of the first portion on a near side with respect to the second heat generating resistor is provided at a position closer to the second heat generating resistor than an outline of the second portion on a near side with respect to the second heat generating resistor; and in the lateral direction, at least a portion of an outline of the first portion on a far side with respect to the second heat generating resistor is provided at a position closer to the second heat generating resistor than an outline of the second portion on a far side with respect to the second heat generating resistor.

Further features of the present disclosure will become apparent from the following description of exemplary embodiments with reference to the attached drawings.

DESCRIPTION OF THE EMBODIMENTS

First Exemplary Embodiment

Hereinafter, configurations and advantages of an image forming apparatus, a fixing apparatus, and a heater according to the present exemplary embodiment will be described.

Image Forming Apparatus

Figure 1:
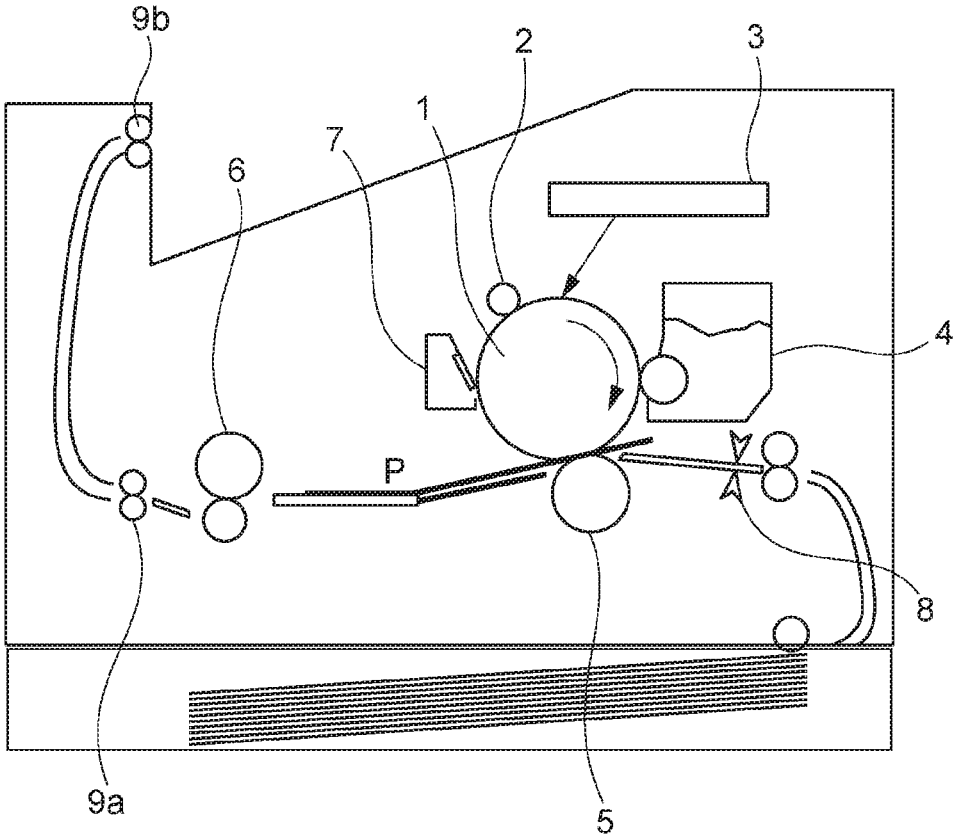
FIG. 1 is a diagram illustrating a schematic configuration of an image forming apparatus according to a first exemplary embodiment.

FIG. 1 is a schematic block diagram of an electrophotographic image forming apparatus according to the present exemplary embodiment.

A photosensitive drum 1 is a member in which a photosensitive portion is formed on a cylinder-shaped base formed of aluminum or nickel. The photosensitive drum 1 is first rotatably driven in the arrow direction, and a surface thereof is uniformly charged with a charging roller 2 serving as a charging apparatus. Subsequently, a laser scanner 3 performs scanning exposure on the photosensitive drum 1 with a laser beam controlled in accordance with image information, and an electrostatic latent image is formed. The electrostatic latent image is developed and made visible with a developing apparatus 4.

By applying a voltage to a transfer roller 5 serving as a transfer device, a toner image that has been made visible is transferred from the photosensitive drum 1 onto a recording material P conveyed at a predetermined timing. In so doing, a conveyance timing of the recording material P is controlled in accordance with an output of a sensor 8 that detects a front edge of the recording material P so that a position where the toner image is formed on the photosensitive drum 1 matches a recording start position at the front edge of the recording material P. The recording material P conveyed at the predetermined timing is pinched and conveyed between the photosensitive drum 1 and the transfer roller 5 while receiving a constant pressure. The recording material P to which the toner image has been transferred is conveyed towards a fixing apparatus 6 and the toner image is fixed to the recording material P as a permanent image by having the recoding material P in a pressurized state be heated. Meanwhile, the residual toner on the photosensitive drum 1 remaining after the transfer is removed from the surface of the photosensitive drum 1 with a cleaning device 7. The recording material P to which the toner image has been fixed by the fixing apparatus 6 is conveyed with pairs of discharge rollers 9*a* and 9*b* and is discharged external to the apparatus.

Fixing Apparatus

Figure 2A:
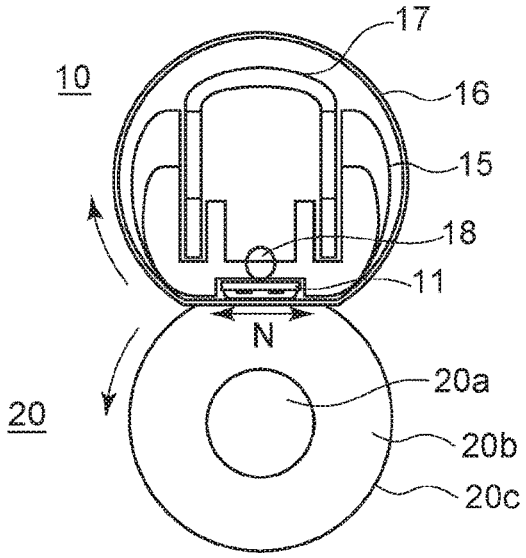
FIGS. 2A and 2B are diagrams illustrating a schematic configuration of a fixing apparatus according to the first exemplary embodiment.
Figure 2B:
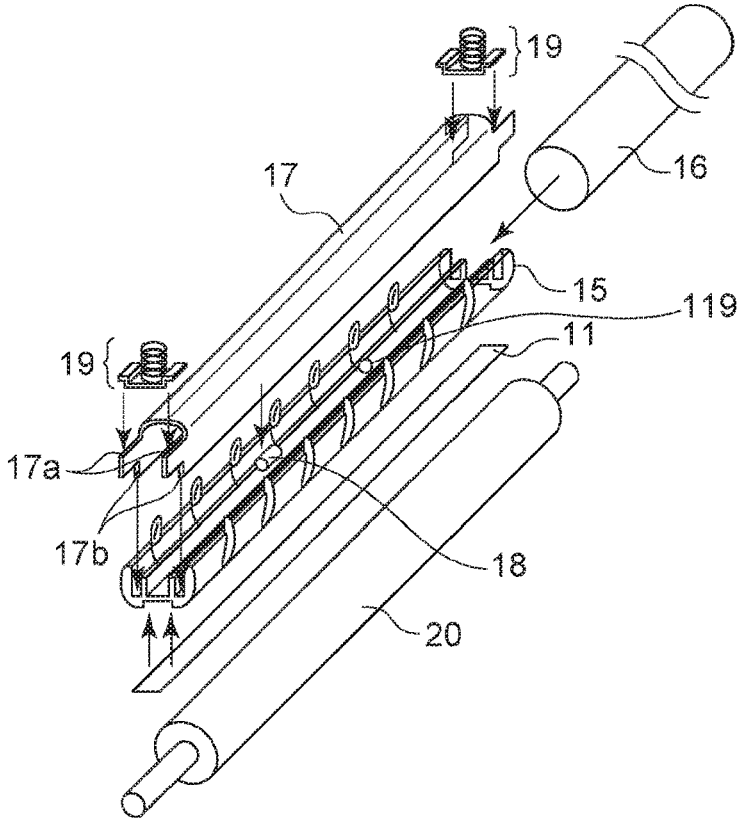

FIGS. 2A and 2B are schematic diagrams illustrating a schematic configuration of the fixing apparatus 6 according to the present exemplary embodiment. FIGS. 2A and 2B are, respectively, a cross-sectional view of the fixing apparatus 6 and a perspective view of the fixing apparatus 6 in a disassembled state. The fixing apparatus 6 is a film heating fixing device including a film assembly 10 and a pressure roller 20 that form a nip portion N by being in pressure contact with each other. The film assembly 10 mainly includes a tubular fixing film (a fixing member) 16, a heater 11, a heater holder 15 serving as a support member that supports the heater 11, pressurizing springs 19, a metal stay 17. The metal stay 17 is compressed by the pressurizing springs 19, and the metal stay 17 countering the pressure of the pressure roller 20 presses the heater holder 15 with the pressure of the pressurizing springs 19. The metal stay 17 is formed so as to have an inverted U-shaped section in order to form a fixing nip portion N that has a substantially uniform width across the longitudinal direction of the fixing member. Both ends of the metal stay 17 in the longitudinal direction protrude from the heater holder 15, and spring receiving portions 17*a* at both ends receives pressure from the pressurizing springs 19 through spring receiving members. The load is uniformly transmitted across the longitudinal direction of the heater holder 15 through stay leg portions 17*b*.

The heater holder 15 is formed of a heat-resistant resin, such as a liquid crystal polymer, a PPS, or a PEEK. Supply of heat from the heater to the fixing film 16 improves by thermally insulating a back surface of the heater 11. Accordingly, it is better that the thermal conductivity of the heater holder 15 is low, and the resin layer may contain a filler, such as glass fiber, glass balloons, or silica balloons. In the present exemplary embodiment, a liquid crystal polymer having glass fiber mixed therein is used, and the thermal conductivity is about 0.4 W/mK. The heater holder 15 also has a function of guiding the rotation of the fixing film 16. The heater holder 15 is provided with a groove hole in which the heater 11 is fitted to hold the heater 11. Through-holes are provided in portions of the groove hole of the heater holder 15, and a temperature detecting element 119 and a power shut-off member 18 directly in contact with the back surface of the heater 11 are disposed in the hole portions.

The fixing film 16 is a heat resistant film having a total thickness of 200 μm to allow a quick start. The fixing film 16 includes a base layer formed of heat-resistant resin, such as polyimide, polyamide-imide, or PEEK, or a metal belt formed of stainless steel, nickel, or the like. Among the above, the former heat-resistant resin may have high thermal conductive powder, such as BN, alumina, or Al mixed therein to improve thermal conductivity. Furthermore, in order for the fixing apparatus to have a long life, the optimum total thickness needed in the fixing film 16 is 20 μm or more so that the fixing film 16 has sufficient strength and excellent endurance. Accordingly, the optimum total thickness of the fixing film 16 is in the range of 20 μm to 200 μm, inclusive. Furthermore, in order to prevent offsets and to obtain separability of the recording material, a release layer is formed on the surface layer by coating a mixture of or either one of heat-resistant resins which have satisfactory release properties, such as a fluororesin (PTFE or PFA, for example) or a silicone resin. Note that PTFE is polytetrafluoroethylene, PFA is tetrafluoroethylene/perfluoroalkylvinyl ether copolymer. The application method includes coating such as dipping and spray coating, and tube covering. In the present example, the base layer is formed of polyimide and is 55 μm thick. An adhesive layer is provided on the base layer and, as a surface layer, 12 μm thick PFA, to which a conductive material has been added, is coated on the adhesive layer. The total thickness of the fixing film is 70 μm, and the diameter thereof is 18 mm. A filler having high thermal conductivity is mixed to the base layer of the fixing film to achieve high thermal conductivity.

The power shut-off member 18 is a member including a switch portion that is actuated by the heat of the heater. When the switch portion is opened by heat, power supply to the heater 11 is shut off. The power shut-off member 18 is in contact with the back surface of the heater 11 at a predetermined pressure. A thermal switch or a thermal fuse may be used as the power shut-off member 18. In the present exemplary embodiment, a thermal fuse is used. The thermal fuse is filled with a pellet that melts at 226° C. and a spring mechanism becomes operated by the melting of the pellet; accordingly, the electric current is shut off. The power shut-off member 18 is provided inside a minimum sheet passing area of the heater 11, which is an area where the recording material P having the smallest size, the size being designated in the specification of the image forming apparatus as being the smallest size that can be used, passes. Furthermore, the power shut-off member 18 is urged at a pressure of 400 gf and is in contact with the heater 11 at the center of the heater 11 in the lateral direction. The power shut-off member 18 of the present exemplary embodiment has a cylindrical shape. The length of the cylindrical metal housing in the longitudinal direction is 10 mm, and the width (diameter) is about 4 mm. Since, when the heater 11 reaches an abnormal temperature, the temperature of the power shut-off member 18 needs to promptly increase so that the electric power supply to the heater 11 is shut off, the outer cylinder of the power shut-off member 18 is formed of metal. The power shut-off member 18 is installed on the back surface of the heater 11 with thermally conductive grease (SC-102 manufactured by Dow Corning Toray Co., Ltd. and having a thermal conductivity of 0.9 W/mK, for example) in between so that malfunction and operating delay, which are caused by a portion of the power shut-off member 18 lifting away from the heater 11, are prevented.

The pressure roller 20 is an elastic roller in which a release layer 20*c* is formed on an elastic layer 20*b* that is formed outside a metal core 20*a* formed of metal, such as stainless steel or aluminum. An elastic solid rubber formed of a heat-resistant rubber, such as a silicone rubber or a fluororubber, or, in order to provide higher insulation effect, an elastic sponge rubber formed by foaming a silicone rubber is used for the elastic layer 20*b*. Other than the above, for example, an elastic foam rubber having increased insulation effect by dispersing a hollow resin filler (microballoons, for example) inside a silicone rubber layer may be used as the elastic layer 20*b*. The release layer 20*c* formed of PFA, PTFE, or the like is formed outside the elastic layer 20*b*. In the present exemplary embodiment, the diameter of the pressure roller 20 is 14.2 mm, the thickness of the silicone rubber layer is 2.5 mm, the release layer is formed of PFA and the thickness thereof is 20 μm, and the hardness of the product is 49 degrees in Asker C hardness.

The pressure roller 20 receives, from a drive gear (not shown) provided in an end portion of the metal core 20*a*, driving force that rotates the pressure roller 20 in the direction of the arrow in FIG. 2A. The driving force is transmitted by a motor (not shown) according to a command from a CPU (not shown) that controls the controlling member. As the pressure roller 20 is rotationally driven, the fixing film 16 is rotated by frictional force with the pressure roller 20. By having a lubricant, such as a fluorine-based or silicone-based high-temperature grease, between the fixing film 16 and the heater 11, the frictional resistance can be suppressed low, and the fixing film 16 can be rotated smoothly. The fixing nip portion N is formed by the pressure roller 20 and the heater 11 with the fixing film 16 interposed therebetween.

The CPU (not shown) controls the electric power supplied to the heater 11 according to a signal of the temperature detecting element 119, such as a thermistor, provided on a back surface of a substrate 12. The temperature of the fixing nip portion N can be maintained at a desired temperature with the above heater control. The recording material P bearing the unfixed toner image is, while being conveyed, heated at the fixing nip portion N. With the above, the toner image is heat fixed to the recording material.

Heater

Figure 3A:
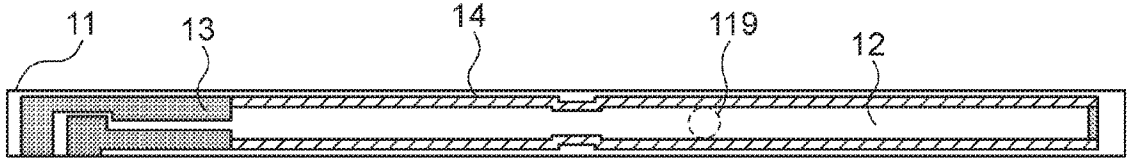
FIGS. 3A and 3B are diagrams illustrating a heater according to the first exemplary embodiment.

Referring to FIG. 3A, the heater 11 used in the fixing apparatus of the present exemplary embodiment will be described. Note that the lateral direction of the heater 11 is the same as the conveying direction of the recording material P, and the longitudinal direction of the heater 11 is, on the conveyance surface of the recording material P, a direction orthogonal to the conveying direction.

The heater 11 is an elongated plate-shaped member that heats the nip portion N by being in contact with an inner surface of the fixing film 16. The heater 11 includes the substrate 12. A conductor 13 and a heat generating resistor 14 that extends in the longitudinal direction of the substrate 12 and that is about 10 μm thick are formed on a surface (the surface on the side which the fixing film 16 slides) of the substrate 12 by screen printing or the like. Note that the power shut-off member 18 and the temperature detecting element 119 described above are in contact with a back surface of the substrate 12 (the surface opposite to the surface on the side which the fixing film 16 slides). The substrate 12 is formed of insulating ceramic, such as alumina or aluminum nitride, and the heat generating resistor 14 is formed of Ag/Pd (silver-palladium), $RuO_2$, $Ta_2N$, or the like. The heat generating resistor 14 includes a heat generating resistor 14*a* (a first heat generating resistor) that extends in the longitudinal direction of the heater 11, and a heat generating resistor 14*b* (a second heat generating resistor) that is arranged together with the heat generating resistor

14*a* in the lateral direction of the heater 11 and that extends in the longitudinal direction of the heater 11. The heat generating resistors 14*a* and 14*b* are, desirably, provided at both ends in the lateral direction of the heater 11 (the substrate 12). If the heat generating resistors 14*a* and 14*b* are arranged at positions near the middle of the heater 11 in the lateral direction and across the longitudinal direction of the heater 11, the temperature difference between the middle and the end portions of the heater 11 in the lateral direction will become large, and the temperature variations will become large. Accordingly, in the present exemplary embodiment, the heat generating resistor 14*a* is formed on a first end side with respect to the middle of the substrate 12 in the lateral direction, and the heat generating resistor 14*b* is formed on a second end side with respect to the middle of the substrate 12 in the lateral direction. There is a gap between the heat generating resistors 14*a* and 14*b*.

The heat generating resistor 14 is connected to an electrode portion (not shown) through the conductor 13, and is configured so that electric power can be supplied from an external member. In the heat generating resistor 14, the heat generating resistors 14*a* and 14*b* are electrically connected to each other through a conductor on a side in the longitudinal direction that is opposite to the side on which the conductor 13 is provided, and employs a configuration in which the heat generating resistor 14*a* is turned back in the longitudinal direction.

A protective layer that protects the heat generating resistor 14 is provided on the surface of the heater 11 that comes in contact with the fixing film 16 within the range that does not hinder the heat efficiency. Desirably, the thickness of the protective layer is sufficiently thin within the range that does not impair the surface property, and the protective layer is formed by coating glass, fluororesin, or the like. In the present exemplary embodiment, as the substrate 12, alumina with a thickness of 1 mm, a width of 5.83 mm in the lateral direction, a length of 270 mm in the longitudinal direction is employed, and the heat generating resistor 14 formed of silver-palladium having a width of about 0.9 mm (the width of each heat generating resistor 14), and a length of 218 mm across the longitudinal direction is formed on the substrate 12. Glass is coated so as to be 60 μm thick as the protective layer that protects the heat generating resistor 14. The total resistance value of the heat generating resistor 14 is 19Ω, and when a rated voltage of 120 V is input, the input electric power is 758 W.

Pattern of Heat Generating Resistor

Figure 3B:
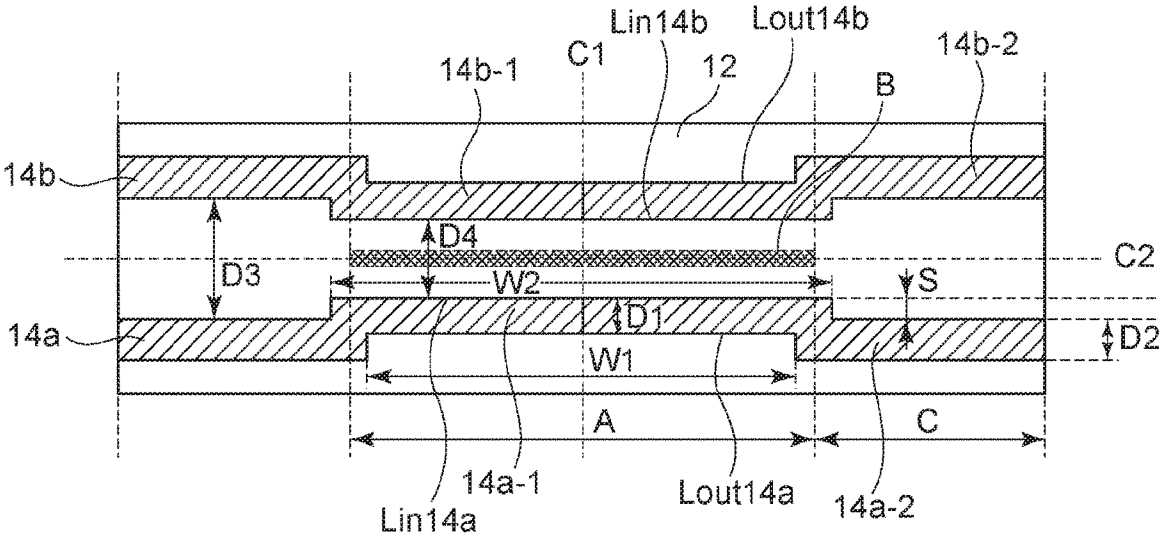
Figure 9A:
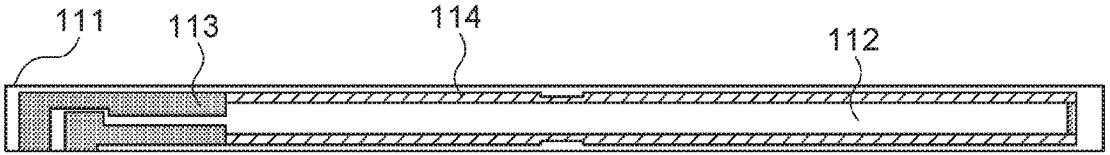
FIGS. 9A and 9B are diagrams illustrating a heater according to a comparative example.
Figure 9B:
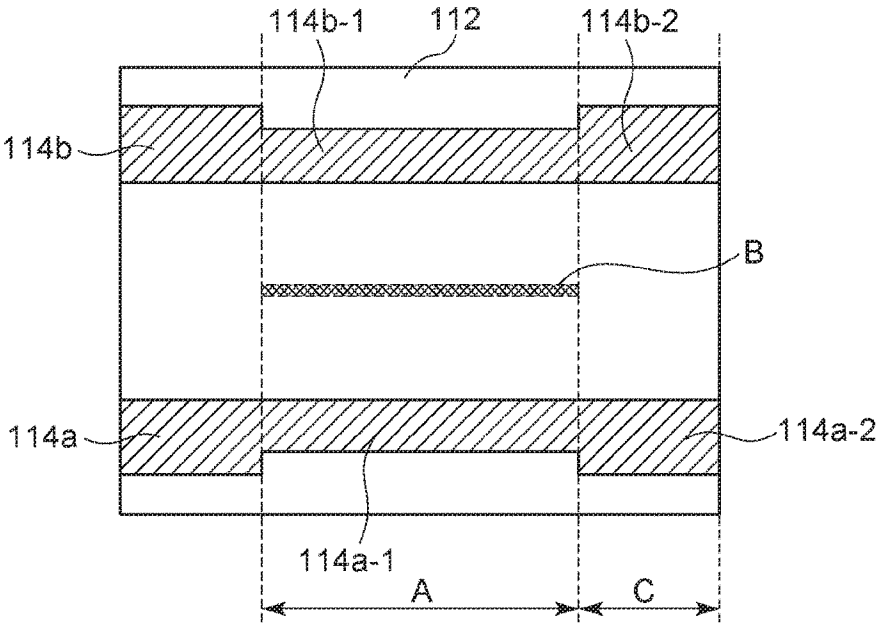

FIG. 9B illustrates a configuration of a vicinity of a contact portion of a power shut-off member of a heater 111 of a comparative example, and FIG. 3B illustrates the configuration of the vicinity of the contact portion of the power shut-off member of the heater 11 of the present exemplary embodiment. Note that FIG. 9B is an enlarged diagram of a portion of FIG. 9A.

In contact area B where the power shut-off member 18 comes in contact with the heater 11 (111), the heat of the heater 11 (111) escapes to the power shut-off member 18; accordingly, heat amounting to the above needs to be compensated. In the case of the heater 11 and the heater 111 of the present exemplary embodiment and the comparative example, the heat generation amount of the heat generating resistors 14*a* (114*a*) and 14*b*(114*b*) in area A needs to be 19% larger than the heat generation amount in area C that is, in the longitudinal direction, an area that is continuous with area A and that does not overlap contact area B. Note that in FIG. 3B, in order to facilitate the understanding of the positional relationship between the heat generating resistor 14 and contact area B, the heat generating resistor 14 and contact area B are illustrated as if they are on the same surface of the substrate 12. In actuality, the heat generating resistor 14 and contact area B are on the surfaces of the substrate 12 that are opposite each other. The same applies to FIG. 9B.

In the comparative example and the present exemplary embodiment, since the heat generating resistor 14 (114) is formed with a uniform thickness by screen printing, the heat generation amount (heat generation amount per unit length) is adjusted by the width of the heat generating resistor 14 (114) in the lateral direction. The heater 11 (111) of the present exemplary embodiment in FIG. 3B and that of the comparative example in FIG. 9B both have the following configuration. The first heat generating resistor 14*a* (114*a*) includes a first portion 14*a*-1 (114*a*-1) that overlaps contact area B in the longitudinal direction of the heater, and a second portion 14*a*-2 (114*a*-2) that is continuous with the first portion 14*a*-1 (114*a*-1) and that does not overlap contact area B. Furthermore, the width of the first portion 14*a*-1 (114*a*-1) is smaller than the width of the second portion 14*a*-2 (114*a*-2). The second heat generating resistor 14*b* (114*b*) includes a third portion 14*b*-1 (114*b*-1) that overlaps contact area B in the longitudinal direction of the heater, and a fourth portion 14*b*-2 (114*b*-2) that is continuous with the third portion 14*b*-1 (114*b*-1) and that does not overlap contact area B. Furthermore, the width of the third portion 14*b*-1 (114*b*-1) is smaller than the width of the fourth portion 14*b*-2 (114*b*-2). As described above, by decreasing the widths of the heat generating resistor 14 (114), the heat generation amount is increased. Note that the heat generation amount needed to be increased in area A of the heater 11 (111) is adjusted as appropriate according to various heat characteristics, such as the heat capacity of the power shut-off member 18, the surface material, and the thermal conductivity. Note that as illustrated in FIG. 3A, in the fixing apparatus of the present exemplary embodiment, the temperature detecting element 119 is, in the longitudinal direction of the heater 11, disposed inside the area where the second portion 14*a*-2 of the first heat generating resistor 14*a* is provided.

In the present exemplary embodiment and the comparative example, the widths of the portions 14*a*-1 (114*a*-1) and 14*b*-1 (114*b*-1) are 19% narrower than the widths of the portions 14*a*-2 (114*a*-2) and 14*b*-2 (114*b*-2). The widths of the portions 14*a*-2 (114*a*-2) and 14*b*-2 (114*b*-2) are each 0.9 mm, and the widths of the portions 14*a*-1 (114*a*-1) and 14*b*-1 (114*b*-1) are each 0.756 mm.

Note that as described above, the heater 111 of the comparative example has two heat generating resistors 114*a* and 114*b* provided at both ends of the substrate 112 in the lateral direction. Accordingly, when electric power is supplied to the heater 111 of the comparative example, since a peak temperature occurs at the portion where the heat generating resistor 114 exists, the temperatures at both ends of the heater 111 in the lateral direction become high. Since the heat generation amount of area A of the heater 111 is larger than area C, the peak temperature of area A is higher than that of area C. Meanwhile, since the heat escapes to the power shut-off member 18 in area B on the back surface of the heater 111, the temperature becomes locally low. As a result, in the comparative example, while a decrease in temperature of the entire heater 111 due to the heat escaping to the power shut-off member 18 can be avoided, the temperature of area A of the heater 111 at both end portions in the lateral direction where the heat generating resistor 114 is provided becomes high, and the temperature of area B becomes locally low. Accordingly, thermal stress due to the temperature difference is created in the substrate 112, and in some cases, the heater 111 becomes broken.

Referring next to FIG. 3B, a pattern of the heat generating resistor 14 according to the present exemplary embodiment will be described. Note that an outline of the heat generating resistor 14*a* that extends in the longitudinal direction of the heater and that is on the near side with respect to the power shut-off member 18 in the lateral direction of the heater is referred to as Lin14*a* (an inner outline), and an outline of the heat generating resistor 14*a* that extends in the longitudinal direction and that is on the far side with respect to the power shut-off member 18 is referred to as Lout14*a* (an outer outline). At least a portion of the inner outline Lin14*a* of the first portion 14*a*-1 of the heat generating resistor 14*a* is positioned closer to the power shut-off member 18 than the inner outline Lin14*a* of the second portion 14*a*-2. Furthermore, at least a portion of the outer outline Lout14*a* of the first portion 14*a*-1 of the heat generating resistor 14*a* is positioned closer to the power shut-off member 18 than the outer outline Lout14*a* of the second portion 14*a*-2.

If the heat generating resistor 14*a* is configured in the above described manner, the advantage described later can be brought about; however, in the present exemplary embodiment, in addition to the above, the outlines of the heat generating resistor 14*b* are configured in a similar manner to those of the heat generating resistor 14*a*. In other words, at least a portion of the inner outline Lin14*b* of the third portion 14*b*-1 of the heat generating resistor 14*b* is positioned closer to the power shut-off member 18 than the inner outline Lin14*b* of the fourth portion 14*b*-2. Furthermore, at least a portion of the outer outline Lout 14*b* of the third portion 14*b*-1 of the heat generating resistor 14*b* is positioned closer to the power shut-off member 18 than the outer outline Lout 14*b* of the fourth linear portion 14*b*-2. As in the present exemplary embodiment, in the case in which the power shut-off member 18 comes in contact with the middle of the substrate 12 in the lateral direction, it is only sufficient that the heater 11 is configured in the following manner.

In other words, in the lateral direction, at least a portion of the outline of the first portion 14*a*-1 on the near side (the side closer to the second heat generating resistor 14*b*) with respect to the power shut-off member 18 is provided at a position (the position closer to the second heat generating resistor 14*b*) closer to the power shut-off member 18 than the outline of the second portion 14*a*-2 on the near side (the side closer to the second heat generating resistor 14*b*) with respect to the power shut-off member 18. Furthermore, in the lateral direction, at least a portion of the outline of the first portion 14*a*-1 on the far side (the side farther to the second heat generating resistor 14*b*) with respect to the power shut-off member 18 is provided at a position (the position closer to the second heat generating resistor 14*b*) closer to the power shut-off member 18 than the outline of the second portion 14*a*-2 on the far side (the side farther to the second heat generating resistor 14*b*) with respect to the power shut-off member 18.

Furthermore, the following configuration is further desirable. In other words, in the lateral direction, at least a portion of the outline of the third portion 14*b*-1 on the near side (the side closer to the first heat generating resistor 14*a*) with respect to the power shut-off member 18 is provided at a position (the position closer to the first heat generating resistor 14*a*) closer to the power shut-off member 18 (the side closer to the first heat generating resistor 14*a*) than the outline of the fourth portion 14*b*-2 on the near side (the side closer to the first heat generating resistor 14*a*) with respect to the power shut-off member 18. Furthermore, in the lateral direction, at least a portion of the outline of the third portion 14*b*-1 on the far side (the first heat generating resistor 14*a*) with respect to the power shut-off member 18 is provided at a position (the position closer to the first heat generating resistor 14*a*) closer to the power shut-off member 18 than the outline of the fourth portion 14*b*-2 on the far side (the side farther to the first heat generating resistor) with respect to the power shut-off member 18.

Furthermore, the following configuration is further desirable. In other words, in the lateral direction, at least a portion of the outline of the third portion on the near side (the side closer to the first heat generating resistor) with respect to the power shut-off member is provided at a position (the position closer to the first heat generating resistor) closer to the power shut-off member (the side closer to the first heat generating resistor) than the outline of the fourth portion on the near side (the side closer to the first heat generating resistor) with respect to the power shut-off member. Furthermore, in the lateral direction, at least a portion of the outline of the third portion on the far side (the first heat generating resistor) with respect to the power shut-off member is provided at a position (the position closer to the first heat generating resistor) closer to the power shut-off member than the outline of the fourth portion on the far side (the side farther to the first heat generating resistor) with respect to the power shut-off member.

The width of the heater of the heat generating resistor 14 of the present exemplary embodiment in the lateral direction, and the length of the heater in the longitudinal direction will be described below. Note that in the present exemplary embodiment, the heat generating resistors 14*a* and 14*b* have the same length and width. D1 is 0.756 mm, D2 is 0.9 mm, D3 is 2.63 mm, D4 is 1.73 mm, W1 is 9.244 mm, and W2 is 10.756 mm. Furthermore, a distance S (L1–L2) between the inner outline of the first portion 14*a*-1 of the heat generating resistor 14 and the inner outline of the second portion 14*a*-2 is 0.45 mm. Similar to the comparative example, in the present exemplary embodiment as well, the width D1 of the first portion 14*a*-1 of the heat generating resistor 14*a* is 19% narrower than the width D2 of the second portion 14*a*-2 so that the heat generation amount of the heater 11 in area A is 19% larger than that in area C.

Note that virtual lines C1 and C2 in FIG. 3B are, respectively, a virtual line that passes the middle of contact area B in the longitudinal direction and that extends in the lateral direction of the heater 11 (the conveying direction of the recording material), and a virtual line that passes the middle of the heater 11 in the lateral direction and that extends in the longitudinal direction of the heater 11. The pattern (the shape) of the heat generating resistor 14 in the vicinity of the power shut-off member 18 of the present exemplary embodiment is symmetrical with respect to the virtual lines C1 and C2.

Advantages

In order to confirm the advantages of the present exemplary embodiment, using the heater 11 (111) of the present exemplary embodiment and the comparative example, a measurement and comparison of the surface temperature distribution of the heater 11 (111), a comparison of the thermal stress through simulation, and operation evaluation tests of the power shut-off member 18 during abnormal temperature rise of the heater 11 (111) using real machines were conducted.

Figure 4:
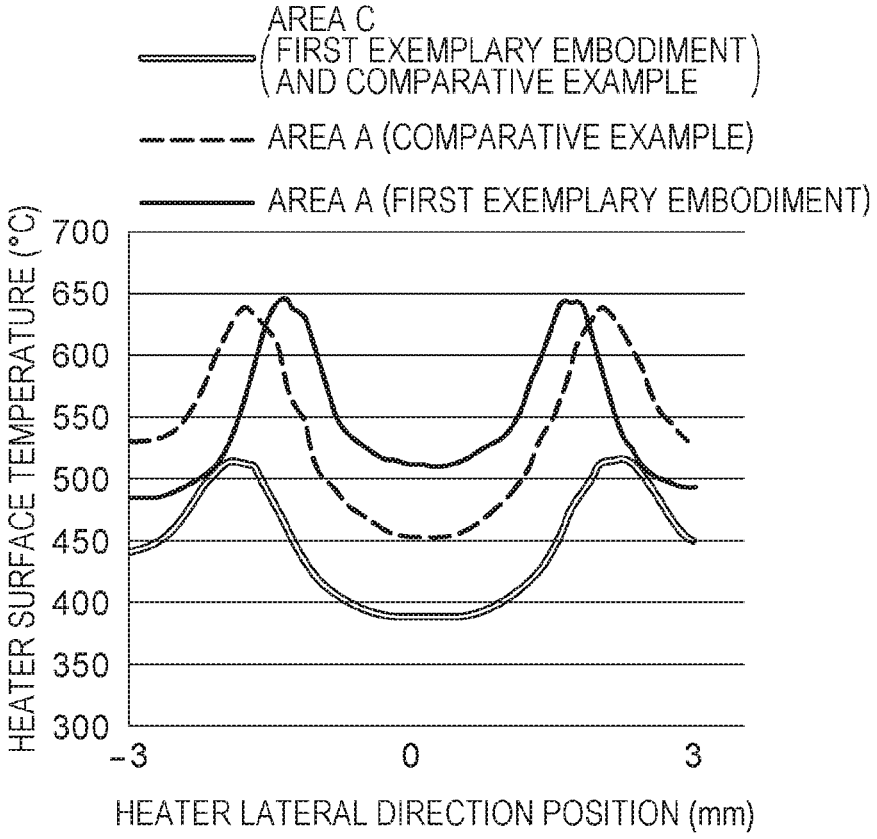
FIG. 4 is a diagram illustrating a temperature distribution of a surface of the heater according to the first exemplary embodiment.

FIG. 4 illustrates a measurement result of the temperature distribution on the surface of the heater 11 (111). In the above measurement, in an environment in which the room temperature was 25° C. and the humidity was 50%, a voltage of 120 V was applied to a single heater 11 (111) (the heater itself not mounted on the fixing apparatus) to make the heater 11 (111) generate heat, and the temperature distribution of the whole heater was measured with a thermography. FIG. 4 illustrates the measurement result after 6 seconds had elapsed from when the supply of electric power had been started. FIG. 4 illustrates the surface temperature distribution of the heater 11 (111) in area A that overlaps contact area B of the power shut-off member, and the temperature distribution of the heater 11 (111) in area C that is continuous from area A in the longitudinal direction and that does not overlap contact area B in the lateral direction.

In area C, since the positions of the heat generating resistor 14*a* (114*a*) and 14*b*(114*b*) of the present exemplary embodiment and the comparative example were the same, there was no difference in the temperature distribution. It was confirmed that in area A of the present exemplary embodiment, the position where the heat generated by the heat generating resistor 14 peaked shifted to the middle portion of the heater in the lateral direction compared with that of the comparative example, and that the temperature at the middle of the heater 11 in the lateral direction, equivalent to contact area B, was higher. Regarding the test conducted with the single heater 11, since the temperature at the middle of the heater 11 in the lateral direction that was in contact with the power shut-off member 18 increased, it can be understood that in the heater 11 of the present exemplary embodiment, the heat easily moves to the middle of the heater 11 in the lateral direction.

Figure 5A:
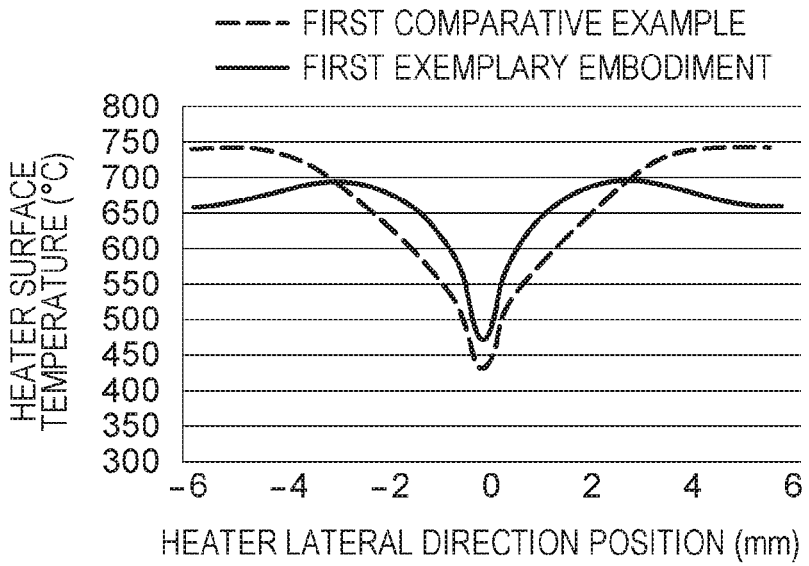
FIGS. 5A and 5B are diagrams illustrating an analytical result of numerical values of thermal stress of the heater according to the first exemplary embodiment.
Figure 5B:
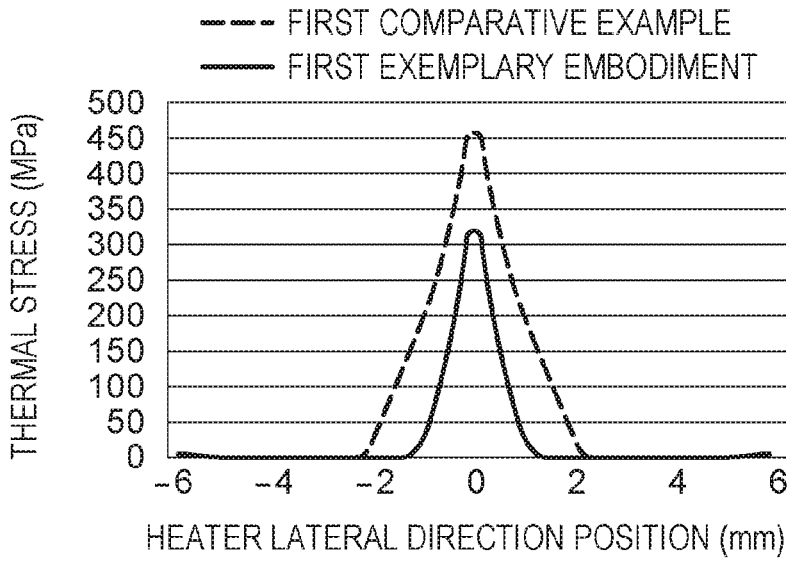

Subsequently, a comparison of the thermal stress created in the heater 11 (111) in a case in which the heater 11 (111) was mounted on the fixing apparatus and the temperature of the heater 11 (111) rose abnormally was made through simulation. Modelling of the entire fixing apparatus was performed, and a heat transfer analysis during abnormal temperature rise of the heater 11 (111) was conducted. The thermal stress acting on the heater 11 (111) was obtained through the above analysis. In the simulation used in the examination, electric power of 1032 W, equivalent to 140 V, was supplied to the heater 11 (111) for 6 seconds under a state in which the rotation of the fixing film 16 was stopped. The calculated results of the temperatures of the back surface of the heater 11 (111) and the thermal stress in the above case is illustrated in FIGS. 5A and 5B. Note that the reason for making the evaluation under a state in which the rotation of the fixing film 16 is stopped is to make the evaluation under a strict condition where the heat of the heater 11 (111) is not easily taken away by the pressure roller 20.

FIG. 5A illustrates a temperature distribution of the back surface of the substrate 12 (112) in the lateral direction at the middle of the heater 11 (111) in area A in the longitudinal direction. Since the first and third portions of the heat generating resistor 114 of the comparative example were disposed at the end portions of the substrate 112 in the lateral direction, the temperatures of the end portions of the substrate 112 in the lateral direction were high and the temperature in contact area B was relatively low. Conversely, in the present exemplary embodiment, since the first and third portions of the heat generating resistor 14 were disposed at portions near contact area B so that a lot of heat could be supplied to contact area B, the decrease in temperature in contact area B was suppressed compared with that in the comparative example.

FIG. 5B illustrates a thermal stress (major principal stress) distribution of the heater in the lateral direction on the back surface of the substrate 12 (112) at a middle portion of the heater in area A of the heater 11 (111) in the longitudinal direction. The comparative example and the present exemplary embodiment were the same in that the thermal stress reached the maximum value in contact area B; however, the maximum values were different. The maximum value of the thermal stress was 453 MPa in the comparative example and was 318 MPa in the present exemplary embodiment. The configuration of the present exemplary embodiment was capable of suppressing thermal stress compared with the configuration of the comparative example.

An operation evaluation test of the power shut-off member was conducted as a comparative verification test of a real machine. In the above test, in a state in which the rotation of the pressure roller 20 had been stopped, electric power was supplied to the heater 11 (111) to raise the temperature of the heater 11 (111) to an abnormal temperature. The time until the power shut-off member starts the shut-off operation was measured after attaching the power shut-off member to a circuit that is independent from the circuit supplying electric power to the heater (the power shut-off member was in contact with the heater), and by making the heater with the above configuration generate abnormal heat. The environment under which the fixing apparatus was installed was a room temperature of 25° C. and a humidity of 50%. Taking the variation in power supply voltage and the variation in the resistance of the heater into consideration, the power supply voltage was adjusted so that the input electric power was 1175 W.

The above test was conducted using the heater 11 of the present exemplary embodiment and the heater 111 of the comparative example. While the power shut-off member 18 operated after about 6 to 6.5 seconds, the breaking time of the heater 111 of the comparative example was about 4.5 to 5.5 seconds. Conversely, when the heater 11 of the present exemplary embodiment was used, the breaking time was about 15 to 16 seconds. It is understood that the heater 11 of the exemplary embodiment has sufficient marginal time before the power shut-off member operates. In the actual fixing apparatus, the power shut-off member 18 is disposed in the circuit that supplies electric power to the heater 11. If the heater 111 of the comparative example is used, the heater 111 may break before the power shut-off member operates when the heater 111 generates abnormal heat. Conversely, when the heater 11 of the exemplary embodiment is used, the heater 11 can be prevented from becoming broken before the operation of the power shut-off member.

An experiment in which electric power is forcibly supplied continuously to the heater 11 (111) while the power shut-off member is configured to not operate was conducted. In such a case, attention was paid to the broken positions of the heater 11 (111). In all of the five samples of the comparative example, the broken position was in contact area B, and the effect of high thermal stress generated on the substrate 112 could be seen. Conversely, in the present exemplary embodiment, concentration of breakage in a specific region was not seen. In the present exemplary embodiment, since the thermal stress acting on contact area B was reduced, generation of early breakage of the heater was suppressed, and it has been indicated that even if there was an abnormal temperature rise of the heater due to an uncontrolled state, shutting out of the supply of electric power to the heater 11 can be performed safely.

Note that in the present exemplary embodiment, the heater 11 having two heat generating resistors 14*a* and 14*b* have been exemplified; however, the heater is not limited to the above configuration. For example, in a heater 11 including four heat generating resistors 14, out of the four heat generating resistors 14, first and third positions of two or more heat generating resistors 14 of the heater 11 may be disposed near contact area B. Furthermore, the heat generating resistor 14 of the present exemplary embodiment has a symmetrical shape with respect to the middle of the substrate in the longitudinal direction and that in the lateral direction; however, the present exemplary embodiment is not limited to the above configuration. The heat generating resistor 14 may be symmetrical with respect to the middle of the power shut-off member 18 in contact area B in the longitudinal direction and in the middle of the power shut-off member 18 in contact area B in the lateral direction.

Second Exemplary Embodiment

The present exemplary embodiment is only different from the first exemplary embodiment in the pattern of the heat generating resistor 14 of the heater 11. Since the other configurations are similar to those of the first exemplary embodiment, description thereof is omitted.

Pattern of Heat Generating Resistor of Present Exemplary Embodiment

Figure 6:
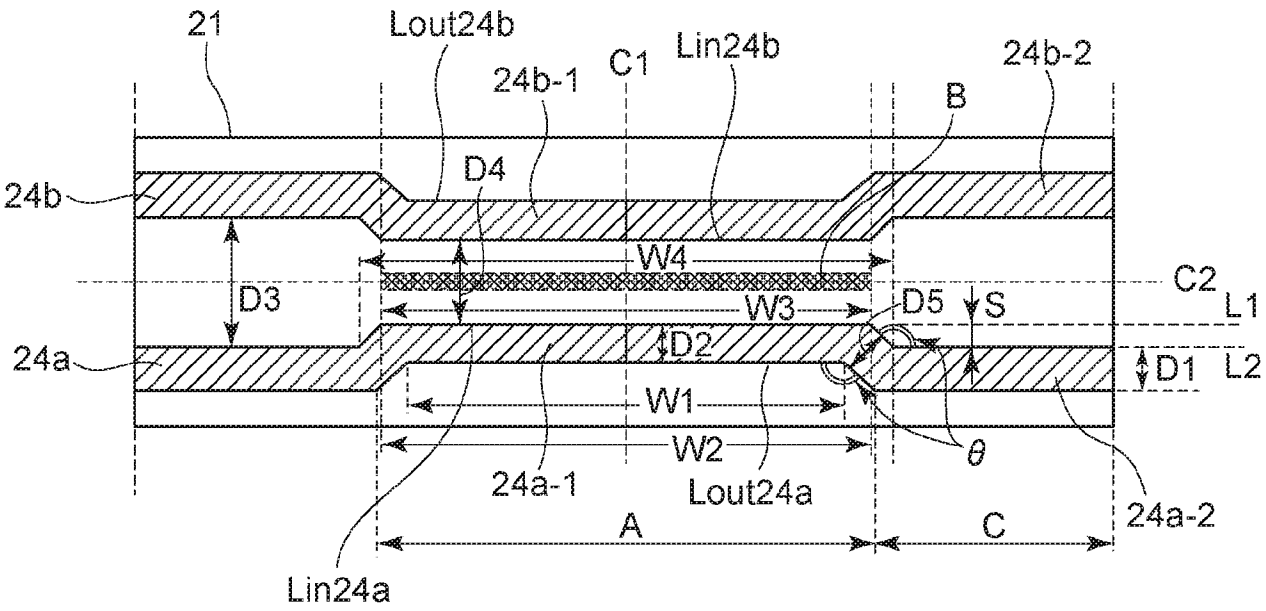
FIG. 6 is a diagram illustrating a heater according to the second exemplary embodiment.

FIG. 6 is a diagram illustrating a shape of a heat generating resistor 24 of a heater 21 according to the present exemplary embodiment, and is a diagram that illustrates a pattern (shape) of the heat generating resistor 24 in the vicinity of an area (a width of 20 mm in the longitudinal direction) of the contact area B of the power shut-off member 18. In the present exemplary embodiment, similar to the first exemplary embodiment, at least a portion of an outline Lin24*a* of a first portion 24*a*-1 of a heat generating resistor 24*a* in area A is provided at a position closer to the power shut-off member 18 than the outline Lin24*a* of a second portion 24*a*-2. Furthermore, at least a portion of an outline Lout24*a* of a first portion 24*a*-1 of the heat generating resistor 24*a* is provided at a position closer to the power shut-off member 18 than the outline Lout24*a* of the second portion 24*a*-2.

The configuration of the present exemplary embodiment that is different from that of the first exemplary embodiment is that the heat generating resistors 24*a* and 24*b* include portions (boundary portions) that, in the vicinity of the boundary between area C and area A, obliquely extends so as to gradually approach the power shut-off member 18 as the boundary portions extend from area A to area C. The boundary portion between area A and area C is synonymous to a boundary portion between the first portion 24*a*-1 and the second portion 24*a*-2 of the heat generating resistor 24*a*, or a boundary portion between a third portion 24*b*-1 and a fourth portion 24*b*-2 of a heat generating resistor 24*b*. An angle θ formed by the direction in which each of the heat generating resistors 24*a* and 24*b* extends in the boundary portion, and the longitudinal direction of the heater 11 is 135° in the present exemplary embodiment. Furthermore, widths and lengths of the heat generating resistors 24*a* and 24*b* in the present exemplary embodiment are as follows. D1 is 0.9 mm, D2 is 0.756 mm, D3 is 2.63 mm, D4 is 1.73 mm, D5 is 0.9 mm, W1 is 8.968 mm, W2 is 10.156 mm, W3 is 10.000 mm, and W4 is 10.900 mm. Furthermore, a distance S (L1–L2) between an inner outline of the first portion 24*a*-1 of the heat generating resistor 24*a* and an inner outline of the second portion 24*a*-2 is 0.45 mm. A width D5 of the heat generating resistor 24 in the boundary portion is 0.9 mm. In other words, regarding the width of the heat generating resistor 24*a*, the boundary portion is wider than the first portion 24*a*-1 to suppress the heat generation amount.

Advantages

In the present exemplary embodiment as well, the first portion 24*a*-1 of the heat generating resistor 24*a* and the third portion 24*b*-1 of the heat generating resistor 24*b* are provided at positions that are close to the contact area B so that the decrease in temperature in the contact area B is small and thermal stress is suppressed.

Figure 7A:
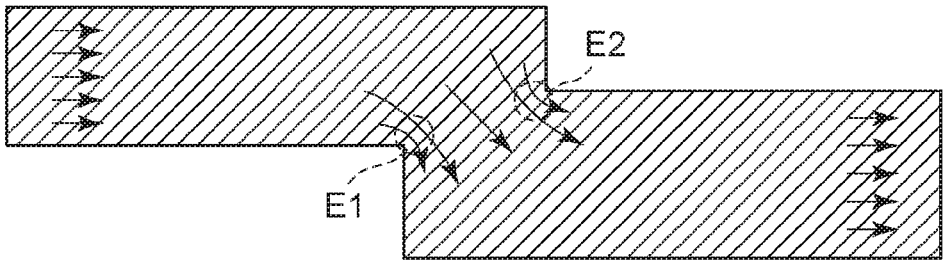
FIGS. 7A and 7B are diagrams illustrating flows of electric currents at boundary portions of the heater according to the second exemplary embodiment.
Figure 7B:
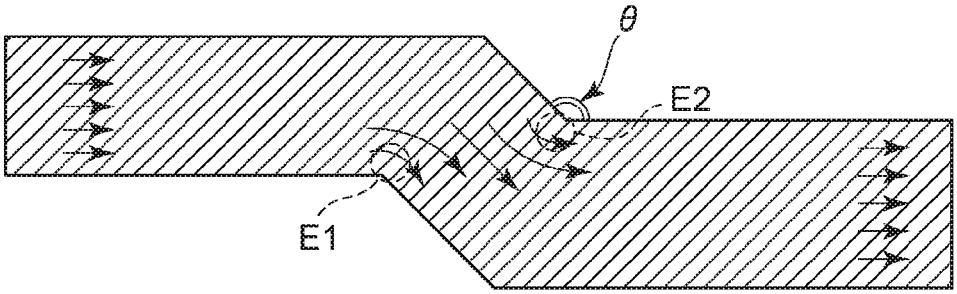

Furthermore, the present exemplary embodiment has an additional advantage in that generation of heat locally in the heat generating resistor 24 at the vicinity of the boundary portion between area A and area C can be reduced and the heat quantity given to the recording material can be made uniform across the longitudinal direction of the heater. The boundary portion above is also the boundary portion between the first portion 24*a*-1 and the second portion 24*a*-2 of the heat generating resistor 24*a*, or the boundary portion between the third portion 24*b*-1 and the fourth portion 24*b*-2 of the heat generating resistor 24*b*. FIGS. 7A and 7B are schematic diagrams illustrating the flows of the electric currents in heaters 11 and 21 in the boundary portions, in which the flows of the electric current are depicted with arrows in the drawings. FIGS. 7A and 7B depict the two flows of the electric current of the first and second exemplary embodiment. In FIG. 7A, since the flow path of the electric current is bent at a right angle at the boundary portion of the heater 11, concentration of electric current easily occurs in bend portions E1 and E2. When the concentration of electric current occurs, there are cases in which the area where the concentration of electric current occurred becomes partially high in heat generation density. Conversely, the electric current flowing through the heat generating resistor 24 of the present exemplary embodiment, as illustrated in FIG. 7B, does not easily become concentrated since the flow path of the electric current is loose. Accordingly, compared with the first exemplary embodiment, the heat generation amount does not become locally high, and a uniform heat generation density can be obtained.

In other words, considering the heat generation amount per unit length in the heater longitudinal direction, the heat generation amount in the vicinity of the boundary portion easily becomes large in the first exemplary embodiment and, on the other hand, the above can be suppressed in the second exemplary embodiment. The present exemplary embodiment is capable of fixing the image to the recording material while providing a uniform heat quantity to the image; accordingly, a satisfactory image can be obtained.

Note that in the present exemplary embodiment, while the angle θ formed in the boundary portion between the direction in which each of the heat generating resistors 24*a* and 24*b* extends and the longitudinal direction of the heater 21 is 135°, the angle is not limited to the above. The angle θ may be larger to obtain a further uniform heat distribution in the heater.

First Modification Example

In the second exemplary embodiment, slopes with a predetermined angle are formed in the vicinity of the boundary portion of the heat generating resistor; however, in a first modification example of the second exemplary embodiment, the bend portions of the heat generating resistor 24 have a curved shape. Note that other than the configuration of the heat generating resistor at the boundary portion, the configuration of the first modification example is similar to that of the second exemplary embodiment.

Figure 8:
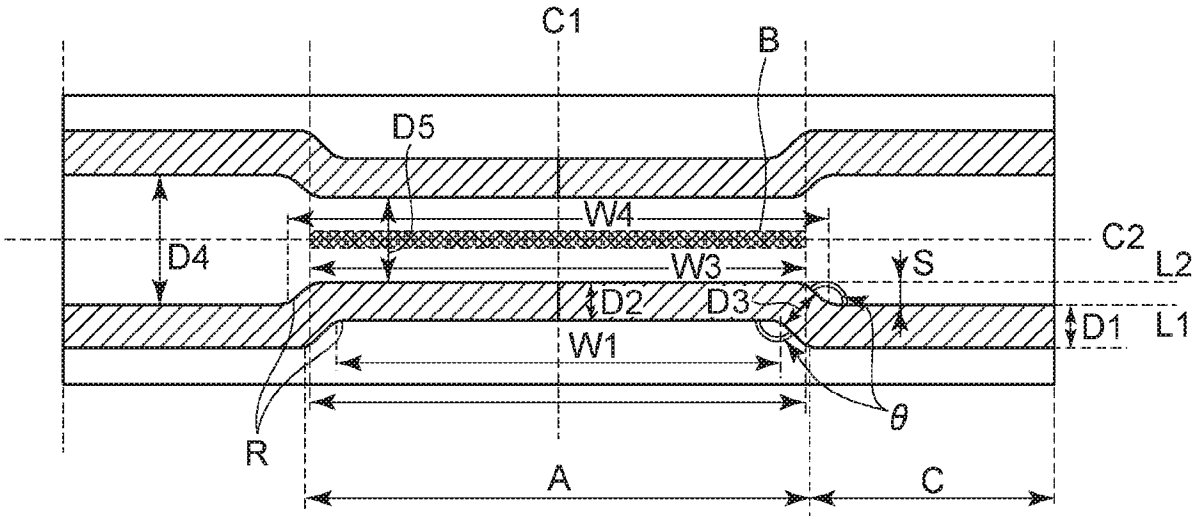
FIG. 8 is a diagram illustrating a heater according to a first modification example.

FIG. 8 illustrates the heat generating resistor 24 according to the first modification example. While the angle θ formed in the second exemplary embodiment is 135°, in the present exemplary embodiment, the bend portions of the heat generating resistor 24 are arcs each having a radius of 4.5 mm.

The first portion and the third portion of the first modification example are also disposed close to the power shut-off member; accordingly, thermal stress acting on the heater can be reduced. Furthermore, by having each bend portion have a circular arc configuration, the flow of the electric current becomes smooth; accordingly, concentration of electric current can be suppressed further and a heater with a more uniform heat generation density can be obtained.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-069288 filed Mar. 30, 2017, which is hereby incorporated by reference herein in its entirety.

What is claimed is:

1. A fixing apparatus comprising:

a fixing member;

a heater that generates heat by electric power supplied thereto, the heater including a substrate, and a first heat generating resistor and a second heat generating resistor provided on the substrate along a longitudinal direction of the substrate; and a power shut-off member that is operated by heat of the heater to shut off supply of the electric power to the heater, the power shut-off member being in contact with the heater at a position between the first heat generating resistor and the second heat generating resistor in a lateral direction of the heater, wherein an image formed on a recording material is fixed to the recording material with the heat of the heater with the fixing member interposed therebetween, wherein a width of a first portion in the lateral direction, the first portion being a portion of the first heat generating resistor that overlaps a contact area between the power shut-off member and the heater in the longitudinal direction, is narrower than a width of a second portion that is a portion of the first heat generating resistor different from the first portion in the longitudinal direction, wherein in the lateral direction, at least a portion of an outline of the first portion on a near side with respect to a virtual line that passes the contact area along the longitudinal direction is provided at a position closer to the virtual line than an outline of the second portion on a near side with respect to the virtual line, and wherein in the lateral direction, at least a portion of an outline of the first portion on a far side with respect to the virtual line is provided at a position closer to the virtual line power shut-off member than an outline of the second portion on a far side with respect to the virtual line.

2. The fixing apparatus according to claim 1, wherein a width of a third portion in the lateral direction, the third portion being a portion of the second heat generating resistor that overlaps the contact area in the longitudinal direction, is narrower than a width of a fourth portion that is a portion of the second heat generating resistor different from the third portion in the longitudinal direction, wherein in the lateral direction, at least a portion of an outline of the third portion on a near side with respect to the virtual line is provided at a position closer to the virtual line than an outline of the fourth portion on a near side with respect to the virtual line, and wherein in the lateral direction, at least a portion of an outline of the third portion on a far side with respect to the virtual line is provided at a position closer to the virtual line than an outline of the fourth portion on a far side with respect to the virtual line.

3. The fixing apparatus according to claim 1, further comprising:

a temperature detecting element that detects a temperature of the heater, the temperature detecting element being disposed in an area in the longitudinal direction where the second portion of the first heat generating resistor is provided.

4. The fixing apparatus according to claim 1, wherein the power shut-off member is a thermal fuse.

5. The fixing apparatus according to claim 1, wherein the fixing member is a tubular film, the heater being in contact with an inner surface of the film.

6. The fixing apparatus according to claim 5, further comprising:

a roller that forms a nip portion together with the heater with the film in between, the nip portion conveying the recording material.

7. A heater used in a fixing apparatus that fixes an image formed on a recording material to the recording material, the heater comprising:

a substrate;

a first heat generating resistor provided on the substrate along a longitudinal direction of the substrate; and a second heat generating resistor provided on the substrate along the longitudinal direction of the substrate, wherein the first heat generating resistor includes a first portion, and a second portion that is a portion of the first heat generating resistor different from the first portion in the longitudinal direction, wherein in a lateral direction of the substrate, the first portion is provided at a position closer to the second heat generating resistor than the second portion, wherein a width of the first portion in the lateral direction is narrower than a width of the second portion, wherein in the lateral direction, at least a portion of an outline of the first portion on a near side with respect to the second heat generating resistor is provided at a position closer to the second heat generating resistor than an outline of the second portion on a near side with respect to the second heat generating resistor, and wherein in the lateral direction, at least a portion of an outline of the first portion on a far side with respect to the second heat generating resistor is provided at a position closer to the second heat generating resistor than an outline of the second portion on a far side with respect to the second heat generating resistor.

8. The heater according to claim 7, wherein a width of a third portion in the lateral direction, the third portion being a portion of the second heat generating resistor that overlaps the first portion of the first heat generating resistor in the longitudinal direction, is narrower than a width of a fourth portion that is a portion of the second heat generating resistor different from the third portion in the longitudinal direction, wherein in the lateral direction, at least a portion of an outline of the third portion on a near side with respect to the first heat generating resistor is provided at a position closer to the first heat generating resistor than an outline of the fourth portion on a near side with respect to the first heat generating resistor, and wherein in the lateral direction, at least a portion of an outline of the third portion on a far side with respect to the first heat generating resistor is provided at a position closer to the first heat generating resistor than an outline of the fourth portion on a far side with respect to the first heat generating resistor.

9. A fixing apparatus comprising:

fixing member; and a heater that generates heat by electric power supplied thereto, the heater including a substrate, and a first and second heat generating resistors provided on the substrate along a longitudinal direction of the substrate, wherein an image formed on a recording material is fixed to the recording material with the heat of the heater with the fixing member interposed therebetween, wherein the first heat generating resistor includes a first portion, and a second portion that is a portion of the first heat generating resistor different from the first portion in the longitudinal direction, wherein in a lateral direction of the substrate, the first portion is provided at a position closer to the second heat generating resistor than the second portion, wherein a width of the first portion in the lateral direction is narrower than a width of the second portion, wherein in the lateral direction, at least a portion of an outline of the first portion on a near side with respect to the second heat generating resistor is provided at a position closer to the second heat generating resistor than an outline of the second portion on a near side with respect to the second heat generating resistor, and wherein in the lateral direction, at least a portion of an outline of the first portion on a far side with respect to the second heat generating resistor is provided at a position closer to the second heat generating resistor than an outline of the second portion on a far side with respect to the second heat generating resistor.

10. The fixing apparatus according to claim 9, wherein a width of a third portion in the lateral direction, the third portion being a portion of the second heat generating resistor that overlaps the first portion of the first heat generating resistor in the longitudinal direction, is narrower than a width of a fourth portion that is a portion of the second heat generating resistor different from the third portion in the longitudinal direction, wherein in the lateral direction, at least a portion of an outline of the third portion on a near side with respect to the first heat generating resistor is provided at a position closer to the first heat generating resistor than an outline of the fourth portion on a near side with respect to the first heat generating resistor, and wherein in the lateral direction, at least a portion of an outline of the third portion on a far side with respect to the first heat generating resistor is provided at a position closer to the first heat generating resistor than an outline of the fourth portion on a far side with respect to the first heat generating resistor.

11. The fixing apparatus according to claim 9, further comprising:

a power shut-off member that is operated by heat of the heater to shut off supply of the electric power to the heater, the power shut-off member being in contact with the heater at a position between the first heat generating resistor and the second heat generating resistor in a lateral direction of the heater and at a position that overlaps the first portion in the longitudinal direction.

12. The fixing apparatus according to claim 11, further comprising:

a temperature detecting element that detects a temperature of the heater, the temperature detecting element being disposed in an area in the longitudinal direction where the second portion of the first heat generating resistor is provided.

13. The fixing apparatus according to claim 11, wherein the power shut-off member is a thermal fuse.

14. The fixing apparatus according to claim 9, wherein the fixing member is a tubular film, the heater being in contact with an inner surface of the film.

15. The fixing apparatus according to claim 14, further comprising:

a roller that forms a nip portion together with the heater with the film in between, the nip portion conveying the recording material.

* * * * *